United States Patent [19]

Tomisawa et al.

[11] 4,026,180

[45] May 31, 1977

[54] ELECTRONIC MUSICAL INSTRUMENT

[75] Inventors: Norio Tomisawa, Hamamatsu; Yasuji Uchiyama, Hamakita; Takatoshi Okumura; Toshio Takeda, both of Hamamatsu, all of Japan

[73] Assignee: Nippon Gakki Seizo Kabushiki Kaisha, Japan

[22] Filed: May 27, 1975

[21] Appl. No.: 581,181

[30] Foreign Application Priority Data

May 31, 1974 Japan ..... 49-61715
May 31, 1974 Japan ..... 49-61716

[52] U.S. Cl. ..... 84/1.25; 84/1.01
[51] Int. Cl.² ..... G04H 1/04
[58] Field of Search ..... 84/1.01, 1.19, 1.23, 84/1.24, 1.25, 1.26

[56] References Cited

UNITED STATES PATENTS

| | | | |
|---|---|---|---|
| 3,515,792 | 6/1970 | Deutsch | 84/1.24 |
| 3,743,755 | 7/1973 | Watson | 84/1.03 |
| 3,767,833 | 10/1973 | Noble et al. | 84/1.01 |
| 3,801,721 | 4/1974 | Bunger | 84/1.24 |
| 3,821,714 | 6/1974 | Tomisawa et al. | 84/1.01 |
| 3,844,379 | 10/1974 | Tomisawa et al. | 84/1.13 |
| 3,929,053 | 12/1975 | Deutsch | 84/1.24 |

*Primary Examiner*—James R. Scott
*Assistant Examiner*—Vit W. Miska
*Attorney, Agent, or Firm*—Ladas, Parry, Von Gehr, Goldsmith & Deschamps

[57] ABSTRACT

In a digital type electronic musical instrument in which basic frequency information corresponding to a depressed key is cumulatively counted and a musical tone waveshape is read from a memory by the resultant output of the cumulative counting, a musical tone including a coarse noise is produced by randomly frequency-modulating the basic frequency of the musical tone, thereby providing the tone with a random vibrato effect. The frequency-modulation is effected by randomly adding or subtracting information expressed in the form of a certain frequency difference relative to the basic frequency information to or from the basic frequency information. According to an embodiment of the invention, a noise effect is produced only during a rise portion of the musical tone by reducing noise component in steps from the start of depression of a key and reproducing a musical tone of a normal pitch after a lapse of a predetermined period of time. The degree of the noise effect can be controlled for each individual keyboard.

6 Claims, 14 Drawing Figures

(a) CHANNEL
1μs
(b)
(c)
(d)
(e)
(f)
(g)
(h)
(i)
Sy1
Sy6
Sy25
$\overline{Sy25}$
READING TIME
ADDITION TIME
SyC
TIME 25μs
(a)
(b)
(c)
300μs
$t_1$
$t_2$
TIME WAVE SHAPE MEMORY
SHIFT REGISTER
SHIFT REGISTER
SHIFT REGISTER
FREQUENCY INFORMATION GENERATOR
SF1
SF2
SF3
AD1
AD2
AD3
5a
5b
5c
6
4
S1 S2 S3 S4 S5 S6 S7
Φ1
A Cin S
B
A Cout
B
C1
C2
Fm1 Fm2 Fm3 Fm4 Fm5 Fm6
Fm7 Fm8 Fm9 Fm10 Fm11 Fm12 Fm13
Fm14
W1
W2
N1
B2

ELECTRONIC MUSICAL INSTRUMENT

SUMMARY OF THE INVENTION

This invention relates to an electronic musical instrument and, more particularly, to an electronic musical instrument capable of producing a unique musical tone having a rough noise by randomly frequency-modulating a musical tone to be reproduced, thereby providing the tone with a random vibrato effect.

A digital type electronic musical instrument which produces a musical tone by digital processing a signal generated upon depression of a key has many advantages over an analog type electronic musical instrument particularly in compactness in size and superior tone quality. It is not long, however, since the digital type electronic musical instrument came into being and there has not been an instrument of this type capable of providing a reproduced musical tone with a special musical tone effect which is inherent in a musical tone produced by a natural musical instrument, such, for example, as a tone resembling a husky voice or a tone containing noise in the rise portion thereof.

It is, therefore, an object of this invention to provide an electronic musical instrument capable of producing a musical tone resembling that of a natural musical instrument.

It is another object of the invention to provide a digital type electronic musical instrument capable of producing a special musical tone resembling a husky voice by randomly frequency-modulating the musical tone to be reproduced with a digitally produced noise.

It is another object of the invention to provide an electronic musical instrument capable of producing a noise effect during an attack of a musical tone such that the tone will have an unstable pitch including a noise resembling a hissing sound produced at the start of playing of wind instrument and thereafter have a stable pitch.

It is another object of the ivention to provide an electronic musical instrument which can be composed of IC and, therefore, made extremely compact and manufactured at a low cost.

It is another object of the invention to provide an electronic musical instrument capable of controlling the husky voice effect individually for each keyboard.

It is still another object of the invention to produce an electronic musical instrument capable of controlling the noise effect produced during attack individually for each keyboard.

These and other objects and features of the invention will become apparent from the description made hereinbelow with reference to the accompanying drawings.

I. General construction

Figure 1:
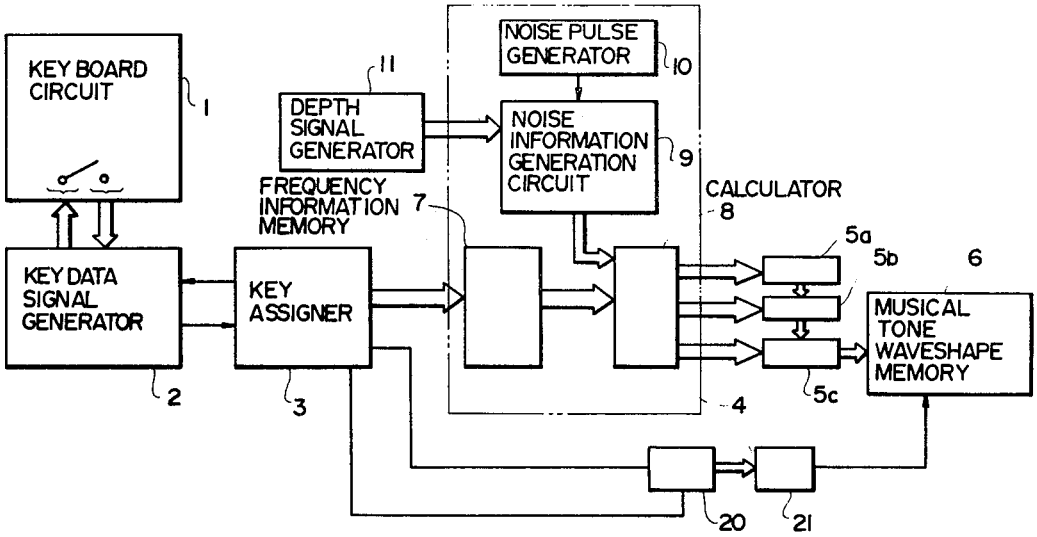
FIG. 1 is a block diagram showing one preferred embodiment of the electronic musical instrument according to the invention.

Referring first to FIG. 1 which shows one preferred embodiment of the electronic musical instrument according to the present invention, a keyboard circuit 1 has make contacts corresponding to respective keys. A key data signal generator 2 comprises a key address code generator which produces key address code indicative of the notes corresponding to the respective keys successively and repeatedly. The key data signal generator 2 produces a key data signal when a make contact corresponding to a depressed key is closed and the key address code corresponding to the depressed key is produced. This key data signal is applied to a key assigner 3. The key assigner 3 comprises a key address code generator which operates in synchronization with the above described key address code generator, a key address code memory which is capable of storing a plurality of key address codes and successively and repeatedly outputting these key address codes and a logical circuit which, upon receipt of the key data signal, applies the key data signal, to the key address code memory for causing it to store the corresponding key address code on the condition that this particular key address code has not been stored in any channel of the memory yet and that one of the channels of the memory is available for storing this key address code.

The frequency information generator 4 comprises a frequency information memory 7, a noise pulse generator 10, a noise information generation circuit 9 and a calculator 8.

The frequency information memory 7 stores frequency information corresponding to the respective key address codes (hereinafter referred to as basic frequency information) and, upon receipt of a key address code from the key assigner 3, produces the basic frequency information corresponding to the key address code. The noise pulse generator 10 generates a noise pulse randomly and the noise information generation circuit 9 operates in response to the noise pulse. The noise information generation circuit 9 produces first noise information represented by a constant frequency difference relative to the basic frequency information when the noise pulse is applied thereto (signal "1") and second noise information which provides the basic frequency information with a constant frequency difference of an opposite polarity to the first noise information when no noise pulse is applied (signal "0"). The calculator 8 conducts addition or subtraction of the basic frequency information and the first or second noise information and sequentially outputs a randomly frequency-modulated frequency information.

This frequency information consists of a fraction section and an integer section as will be described later and is applied to a frequency counter comprising fraction counter 5*a*, 5*b* and an integer counter 5*c*.

A depth signal generation circuit 11 supplies a depth signal to the noise information generation circuit 9. Depth of the depth signal is adjustable in several steps in accordance with operation of an operator (not shown). The magnitude of the first and second noise information is adjusted in accordance with the stage of the depth signal, so that the depth of the frequency modulation, i.e. modulation factor is thereby adjusted.

The fraction counter 5*a* is provided for cumulatively counting its inputs and applying a carry signal to the next fraction counter 5*b* when a carry takes place in the addition. The fraction counter 5*b* is of a like construction, applying a carry signal to the integer counter 5*c* when a carry takes place in the counter 5*b*.

The integer counter 5*c* cumulatively counts the carry signals and integer section information inputs and successively delivers out signals representing the results of the addition. The output signals of the integer counter 5*c* are applied to a plurality of input terminals of a waveshape memory 6. A musical tone waveshape for one period is sampled at n points and the amplitudes of the sampled waveshape are stored at addresses O to *n*-1 of the waveshape memory 6. The musical tone waveshape is read from the waveshape memory 6 by successively reading out the amplitudes at the address corresponding to the output of the integer counter 5*c*.

The entire level of the musical tone waveshape read from the musical tone waveshape memory 6 is controlled by an envelope waveshape signal from an envelope memory 21. The envelope memory 21 stores a waveshape corresponding to an envelope from the start of generation of a musical tone to the stopping thereof and an amplitude at an address corresponding to the output of an envelope counter 20 is sequentially read out. The envelope counter 20 is controlled by signals ES and DIS supplied from the key assigner 3 and representing depression and release of a key respectively.

For achieving the purpose of reproducing plurality of musical tones simultaneously, the present electronic musical instrument has a construction based on dynamic logic so that the counters, logical circuits and memories provided therein are used in a time-sharing manner. Accordingly, time relations between clock pulses controlling the operations of these counters etc. are very important factors for the operation of the present electronic musical instrument.

Figure 2:
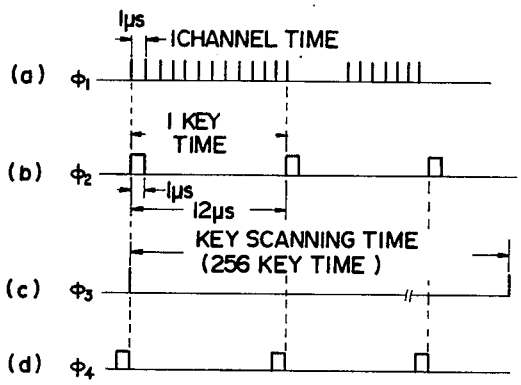
FIGS. 2(*a*) through 2(*d*) are respectively charts showing clock pulses employed in this embodiment of the electronic musical instrument.

Assuming that a maximum number of musical tones to be reproduced simultaneously is twelve, relations between the various clock pulses used in the present electronic musical instrument are illustrated in FIGS. 2(*a*) to 2(*d*). FIG. 2(*a*) shows a main clock pulse $\phi_1$ which has a pulse period of 1 $\mu$s. This pulse period is hereinafter referred to as "channel time" FIG. 2(*b*) shows a clock pulse $\phi_2$ having a pulse width of 1 $\mu$s and a pulse period of 12 $\mu$s. This pulse period of 12 $\mu$s is hereinafter referred to as "key time". FIG. 2(*c*) shows a key scanning clock pulse $\phi_3$ which has a pulse period equivalent to 256 key time. 1 key time is divided by 12 $\mu$s and each fraction of the divided key time is called first, second . . . 12 channel respectively. FIG. 2(*d*) shows a clock pulse $100_c$ which appears only during the 12 channel in each key time. A channel denotes in this specification a shared portion of time, i.e. the channel time.

II. Generation of key address codes

Figure 3:
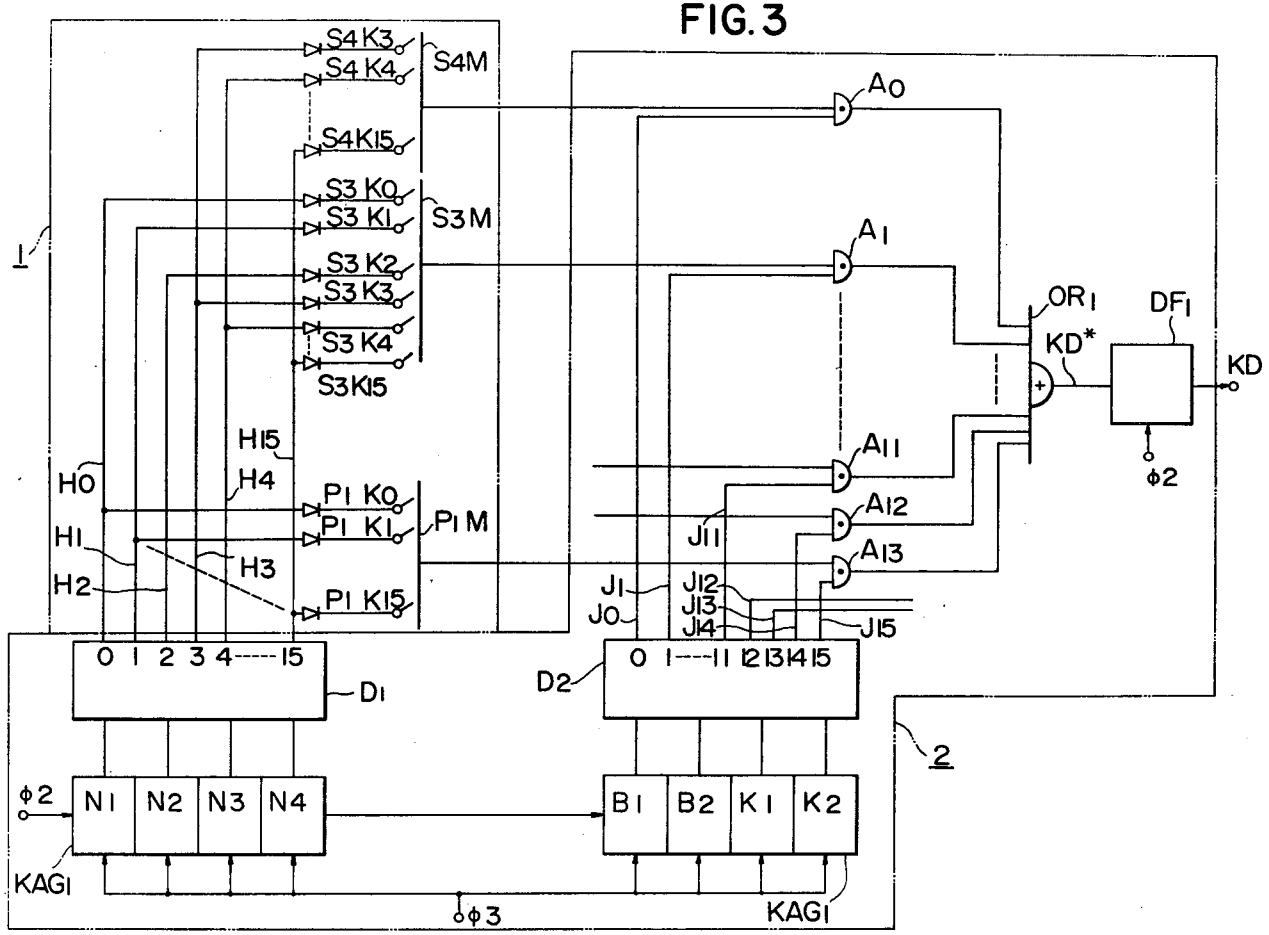
FIG. 3 is a circuit diagram showing a detailed logical circuit of a key data signal generator 2, shown in FIG. 2.

FIG. 3 shows the construction of the key data generator 2 in detail. A key address code generator $KAG_1$ consists of binary counters of eight stages. The clock pulse $\phi_2$ with the pulse period of 12 $\mu$s (hereinafter called a key clock pulse) is applied to the input of the key address code generator $KAG_1$. The key clock pulse applied to the key address code generator $KAG_1$ changes the code, i.e., the combination of 1 and 0 in each of the binary counter stages.

The highest class of electronic musical instrument typically has a solo keyboard, upper and lower keyboards and a pedal keyboard. The pedal keyboard has 32 keys reanging from $C_2$ to $C_4$ and the other keyboards respectively have 61 keys ranging from $C_2$ to $C_7$. Thus, this type of electronic musical instrument has 215 keys in all.

According to the present invention, 256 different codes are produced by the key address code generator $KAG_1$ and 215 codes among them are alloted to the corresponding number of keys. Digits of the key address code generator $KAG_1$ from the least significant digit up to the most significant digit are represented by reference characters $N_1$, $N_2$, $N_3$, $N_4$, $B_1$, $B_2$, $K_1$ and $K_2$ respectively. Among them, $K_2$ and $K_1$ constitute a keyboard code representing the kind of keyboard, $B_2$ and $B_1$ a block code representing a block in the keyboard and $N_1$ through $N_4$ a note representing a musical note in the block. Each keyboard is divided into four blocks each including 16 keys. These blocks are designated as block 1, block 2, blok 3 and block 4 counting from the lowest note side. It is assumed that the key address codes which would correspond to three notes above the actually existing highest key (note $C_6$ of block 4) in the solo keyboard S, upper keyboard U and lower keyboard L and the key address codes which would correspond to the blocks 3 and 4 in the pedal keyboard are not alloted to keys in the present embodiment.

The bit outputs of the key address code generator $KAG_1$ are applied through decoders to the keyboard circuit for sequentially scanning each key. The scanning starts from the block 4 of the solo keyboard S and is performed through the blocks 3, 2, 1 of the solo keyboard S, the blocks 4, 3, 2, 1 of the upper keyboard U, the blocks 4, 3, 2, 1 of the lower keyboard L and the blocks 2, 1 of the pedal keyboard P. One cycle of scanning of all of the keys is thereby completed and this scanning operation is cyclically repeated at an extremely high speed. Scanning time required for one cycle of scanning is $256 \times 12\ \mu s = 3.07$ ms.

Decoder $D_1$ is a conventional binary-to-one decoder designed to receive four-digit binary codes consisting of combinations of the digits $N_1$ to $N_4$ of the key address code generator $KAG_1$ and to deliver an output at one of the sixteen individual output lines $H_0$ through $H_{15}$ successively and sequentially, the binary code in each instance determining a respective output line. The output line $H_0$ is connected through diodes to the key switches corresponding respectively to the highest note of each block (except the blocks 4) of the respective keyboards. The output line $H_1$ is similarly connected to the key switches corresponding to the second highest note of each block the blocks 4. It will be understood that no keys are provided for the three codes on the highest note side in the block 4 of the solo keyboard S, the upper keyboard U and the lower keyboard L and, accordingly, the outer lines $H_0$ to $H_2$ are not connected in the blocks 4. Output line $H_3$ and subsequent output lines are connected in a similar manner to the corresponding key switches of each block (also of block 4).

FIG. 3 illustrates connections between respective key switches and the output lines $H_0$ –$H_{15}$ with respect to the blocks 4 and 3 of the solo keyboards S and the block 1 of the pedal keyboard P. The first letter of the symbols used on the key switches designates the kind of the keyboard, the numeral affixed to the first letter the block number, and the numeral affixed to the letter K a decimal value of the corresponding one of the codes $N_1$ –$N_4$.

Each key switch has a make contact. One contact point thereof is individually connected as has been described above and the other contact point constitutes a common contact for each block. The common contact $S_4M$–$P_1M$ are respectively connected to AND circuits $A_0$–$A_{13}$.

Decoder $D_2$ is a conventional binary-to-one decoder designed to receive four-digit binary codes consisting of combinations of the digits $B_1$, $B_2$, $D_1$ and $K_2$ of the key address code generator $KAG_1$ and to deliver an output at one of the sixteen individual output lines $J_0$ through $J_{15}$ successively and sequentially, the binary code in each instance determining a respective output line. The output lines $J_0$ through $J_{15}$ (except $J_{12}$ and $J_{13}$) are connected to the inputs of the AND circuits $Y_0$ through $Y_{13}$ respectively. The outputs of the AND circuits $Y_0$ through $Y_{13}$ are connected through an OR circuit $OR_1$ to the input of a delay flip-flop circuit $DF_1$.

The codes produced from the key address code generator $KAG_1$ change their contents every time the key clock pulse $\phi_2$ is applied.

If a certain key is depressed, the make contact corresponding to the depressed key is closed. When the key address code generator $KAG_1$ provides a code which corresponds to the depressed key, an output 1 is produced from one of the AND circuits $A_0$–$A_{13}$. This output is provided via an OR circuit $OR_1$. This output is a key data signal KD* which represents the closing of the make contact. This signal is delayed by the delay flip-flop $DF_1$ by one key time and provided therefrom. The key data signals KD*, KD are sequentially output with an interval of 3.07 ms as long as the make contact remains closed.

The foregoing description has been made with regard to a case where only one key is depressed. If a plurality of keys are depressed simultaneously, key data signals respectively corresponding to the depressed keys are produced in the same manner and different musical tone wave shaped respectively corresponding to these key data signals are obtained. For convenience of explanation, description will be made hereinbelow about a case where only one key is depressed to obtain one musical tone waveshape.

Figure 4:
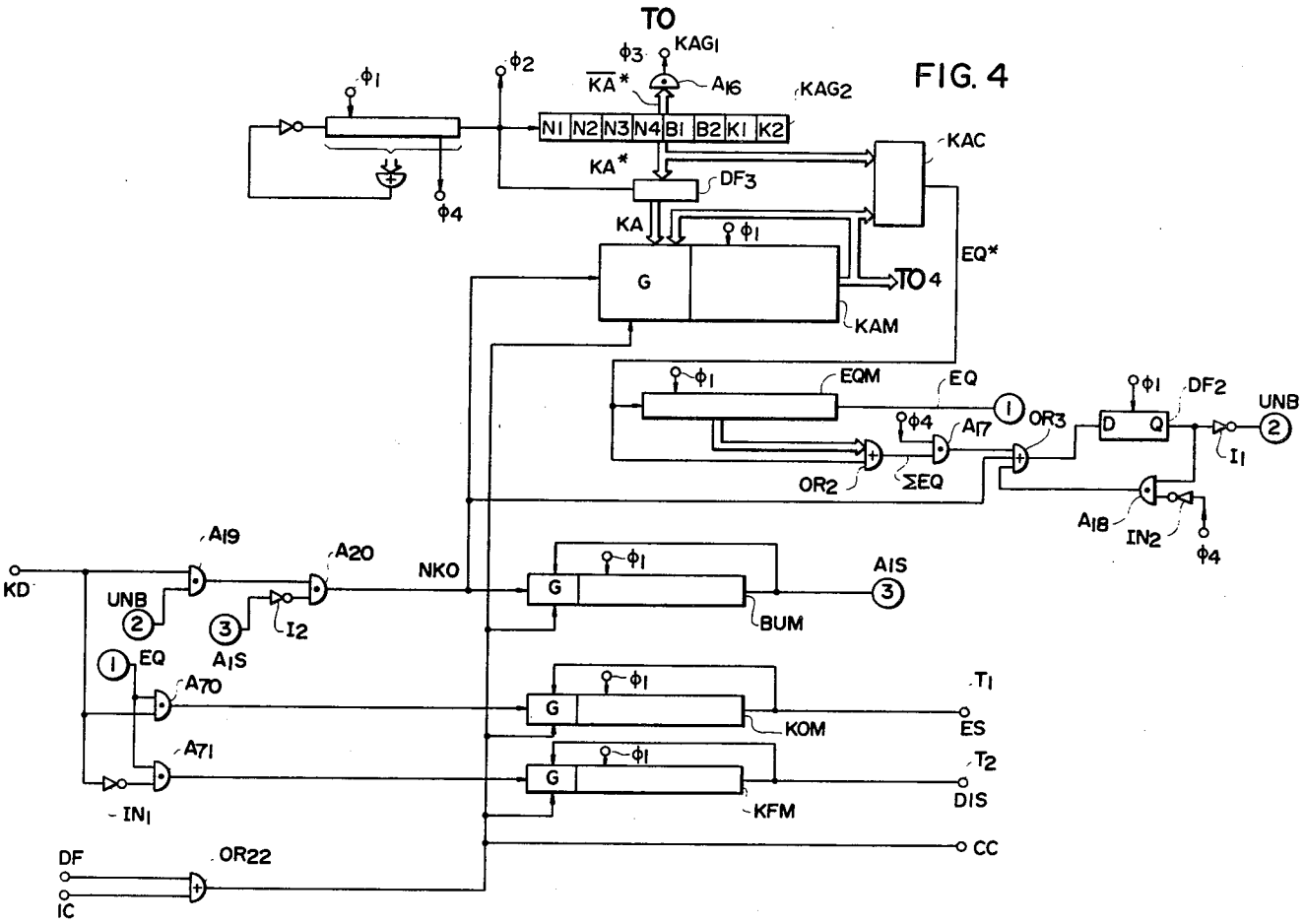
FIG. 4 is a circuit diagram showing a detailed logical circuit of a key assigner 3 shown in FIG. 1.

FIG. 4 is a block diagram showing the construction of the key assigner 3 in detail. A key address code memory KAM memory channels of a number equal to that of the musical tones to be reproduced at the same time, each of these channels storing a key address code representing the musical note being played. The key address code memory KAM is adapted to apply the key address code in a time-sharing manner to the frequency information generator 4 as a frequency designation signal. In the present embodiment, a shift register of 12 words — 8 bits is utilized as the key address code memory KAM. This shift register performs shifting upon receipt of the main clock pulse $\phi_1$ produced at an interval of 1 $\mu$s. The output from the last stage of this shift register is provided to the frequency information memory and, simultaneously, fed back to its input side. Accordingly, each key address code is circulated in the shift register at a cycle of 1 key time (12 $\mu$s) unless the code is cleared from its corresponding channel.

A key address code generator $KAG_2$ is of the same construction as the key address code generator $KAG_1$. These two generators $KAG_1$ and $KAG_2$ operate in exact synchronization with each other. More specifically, the key clock pulse $\phi_2$ is used as input signals to both of the generators $KAG_1$ and $KAG_2$ and the fact that the respective bits of the key address code generator $KAG_2$ are all "0" is detected by an AND circuit $A_{16}$ and the detected signal $\phi_3$ is applied to the reset terminals of the respective bits of the key address code genertor $KAG_1$ as the key scanning clock signal.

The key assigner 3 causes the key address code memory KAM to store a key address code corresponding to the key data signal KD upon receipt thereof when the following two condition are satisfied:

Condition (A); The key address code is not identical with any of the codes already stored in the key address code memory KAM.

Condition (B); there is a not-busy channel, i.e. a channel in which no code is stored, in the key address code memory KAM.

Assume now that a key data signal KD* is produced from the OR circuit $OR_1$. At this time the key address code from the key address code generator $KAG_2$ coincides with the code of the key address code generator $KAG_1$ and represents the note of the depressed key. During the 12 $\mu$s period, the key address code KA* is applied to a comparison circuit KAC in which the code KA* is compared with each output of the channels of the key address code memory KAM. A coincidence signal EQ* produced from the comparison circuit KAG is 1 when there is coincidence and 0 when there is no coincidence. The coincidence signal EQ* is applied to a coincidence detection memory EQM and also to one input terminal of an OR circuit $OR_2$. This memory EQM is a shift register having a suitable number of bits, e.g. 12 as in this embodiment. The memory EQM successively shifts the signal EQ*, i.e. delays it by one key time when the signal EQ* is 1 and thereby produces a coincidence signal EQ (=1). Each of the outputs from the first to eleventh bits of the coincidence detection memory EQM is applied to the OR circuit $OR_2$. Accordingly, the OR circuit $OR_2$ produces an output when either the signal EQ* from the comparison circuit KAC or one of the outputs from the first to 11 bits of the shift register EQM is 1. The output signals $\Sigma$ EQ of the OR circuit $OR_2$ is applied to one of the input terminals of an AND circuit $A_{17}$. The AND circuit $A_{17}$ receives a clock pulse $\phi_4$ at the other input terminal thereof. Since information stored in the shift register before the first channel is false information, correct information, i.e. information representing the result of comparison between the key address code KA* and the codes in the respective channels of the key address code memory KAM is obtained only when the result of the comparison in each of the first to 11 channels is applied to the coincidence detection memory EQM and the result of comparison in the twelfth channel is applied directly to the OR circuit $OR_2$. This is the reason why the clock pulse $\phi_4$ is applied to the AND circuit $A_{17}$.

If the signal Σ EQ is 1 when the clock pulse $\phi_4$ is applied, the AND circuit $A_{17}$ produces an output "1" which is applied through an OR circuit $OR_3$ to a delay flip-flop $DF_2$. The signal is delayed by this delay flip-flop $DF_2$ by one channel time and fed back thereto via an AND circuit $A_{18}$. Thus, the signal 1 is stored during one key time until a next clock pulse $\phi_4$ is applied to the AND circuit $A_{18}$ through an inverter $IN_2$. The output 1 of the delay flip-flop $DF_2$ is inverted by an inverter $I_1$ and is provided as an unblank signal UNB. Thus unblank signal UNB indicates that the same code as the key address code KA* is not stored in the key address code memory KAM when it is 1, and that the same code as the key address code KA* is stored in the memory KAM when it is 0.

As described in the foregoing, presence of the condition (A) is examined during production of the key data signal KD*. In other words, whether the key data signal is an old signal which has already been stored or a new one which has not been stored in the memory is examined. The unblank signal UNB which indicates the result of the examination is applied to one input terminal of an AND circuit $A_{19}$ during the next one key time. The key data signal KD is delayed by one key time and applied to the other input terminal of the AND circuit $A_{19}$. Accordingly, whether a key address code corresponding to the key data signal KD is stored in the memory KAM is examined by one key time immediately before the application of the key data signal KD is applied to one of the input terminals of an AND circuit $A_{20}$ via the AND circuit $A_{19}$. When the unblank signal UNB is 0, the key data signal KD is not gated out of the AND circuit $A_{19}$.

In order for new key address code to be stored in the key address code memory KAM, at least one of the 12 channels of the memory must be in a not-busy state, i.e. available for storage. A busy memory BUM is provided to detect whether there is a not-busy channel in the key address code memory. The busy memory BUM consists of a shift register of 12 bits, and is adapted to store 1 when a new key-on signal NKO is applied thereto from the AND circuit $A_{20}$. This signal 1 is sequentially and cyclicly shifted in the busy memory BUM. This new key-on signal is simultaneously applied to the key address code memory KAM so as to cause the memory KAM to store the new key address code. Accordingly, the signal 1 is stored in one of the channels of the busy memory BUM corresponding to the busy channel of the key address code memory KAM. Contents of a not-busy channel are 0. Thus, the output of the final stage of the busy memory BUM indicates whether this channel is busy or not. This output is hereinafter referred to as a busy signal AIS.

This busy signal AIS is applied to one of the input terminals or the AND circuit $A_{20}$ via an inverter $I_2$. When the signal AIS is 0, i.e., a certain channel is not busy, the key data signal is applied to the busy memory BUM as the new key-on signal via the AND circuit $A_{20}$ thereby causing the busy memory BUM to store 1 in its corresponding channel. Simultaneously, the gate G of the key address code memory KAM is controlled so that the key address code KA from a delay flip-flop $DF_3$ will be stored in a not-busy channel of the memory KAM.

The delay flip-flop $DF_3$ is provided for delaying the output KA* of the key address code generator KAG by one key time so that a key address code corresponding to the key data signal KD may be stored in snychronization with the key data signal KD, since the key data signal KD* which is delayed on one key time is applied to the key assigner.

The new key-on signal NKO from the AND circuit $A_{20}$ is applied through the OR circuit $OR_3$ to the delay flip-flop $DF_2$ to set the flip-flop, and the unblank signal UNB becomes 0. Accordingly, the output of the AND circuit $A_{19}$ become 0 when the unblank signal UNB becomes 0 thereby changing the new key-on signal NKO to 0. This arrangement is provided to ensure storage of the key address code KA is only one, and not two or more, not-busy channel of the key address code memory KAM.

In this way, 12 kinds of key address codes are stored in the key address code memory KAM, and these address codes are shifted by the main clock pulse $\phi_1$ and the output of the final stage are successively applied to the frequency information generator 4 and also fed back to the input side of the memory KAM for cyclically producing outputs therefrom, changing at a rate of 1 $\mu$s, i.e. the same code appearing once every 12 $\mu$s.

It should be noted that the key address codes $N_1$-$B_2$ representing the notes are applied to the frequency information memory and the key address codes $K_1$, $K_2$ representing the keyboards are utilized as desired for controlling a musical tone for each keyboard.

Assume now that a key address code has been stored in the first channel. If the key data signal KD is applied to one of the input terminals of an AND circuit $A_{70}$, a signal 1 is applied to the other input terminal of the AND circuit $A_{70}$, since 1 is already stored in the first channel of the coincidence memory EQM. Accordingly, the key data signal KD is gated out of the AND circuit $A_{70}$ only during the time corresponding to the first channel and stored in the first channel of the key-on memory KOM. The storage of the signal 1 in the key-on memory KOM represents a state in which the make contact of the key switch is closed (hereinafter referred to as "key-on").

The signal 1 of the first channel of the key-on memory KOM is also supplied to a terminal $T_1$ as an attack start signal ES. This attack start signal ES is continuously produced until the signal 1 of the first channel of the key-on memory KOM is reset as will be described later.

When the key is released, the key data signal ceases to be produced. This causes a signal 1 produced through an inverter $IN_1$ to be applied to one of the input terminals of the AND circuit $A_{70}$. The coincidence signal EQ is still being applied to the other input terminal of the AND circuit $A_{70}$. Accordingly, a signal 1 is stored in the first channel of a key-off memory KFM. The contents of the first channel are successively shifted in the key-off memory KFM and are output from the last stage thereof as a signal 1. This signal "1" which is applied to a terminal $T_2$ represents a key-off state and hereinafter is called a decay start signal DIS.

The contents of the memories of the key assigner 3 are cleared by applying to the input terminal of an OR circuit $OR_{22}$ a counting termination signal DF from an envelope counter to be described later when reading of envelope waveshapes has been completed. The output of the OR circuit $OR_{22}$ is also utilized as a clear signal CC for clearing each counter. One input IC to the OR circuit $OR_{22}$ is an input for resetting the respective memories and counters to their initial conditions upon turing-on of the power.

III. Frequency modulation by noise

Figure 5:
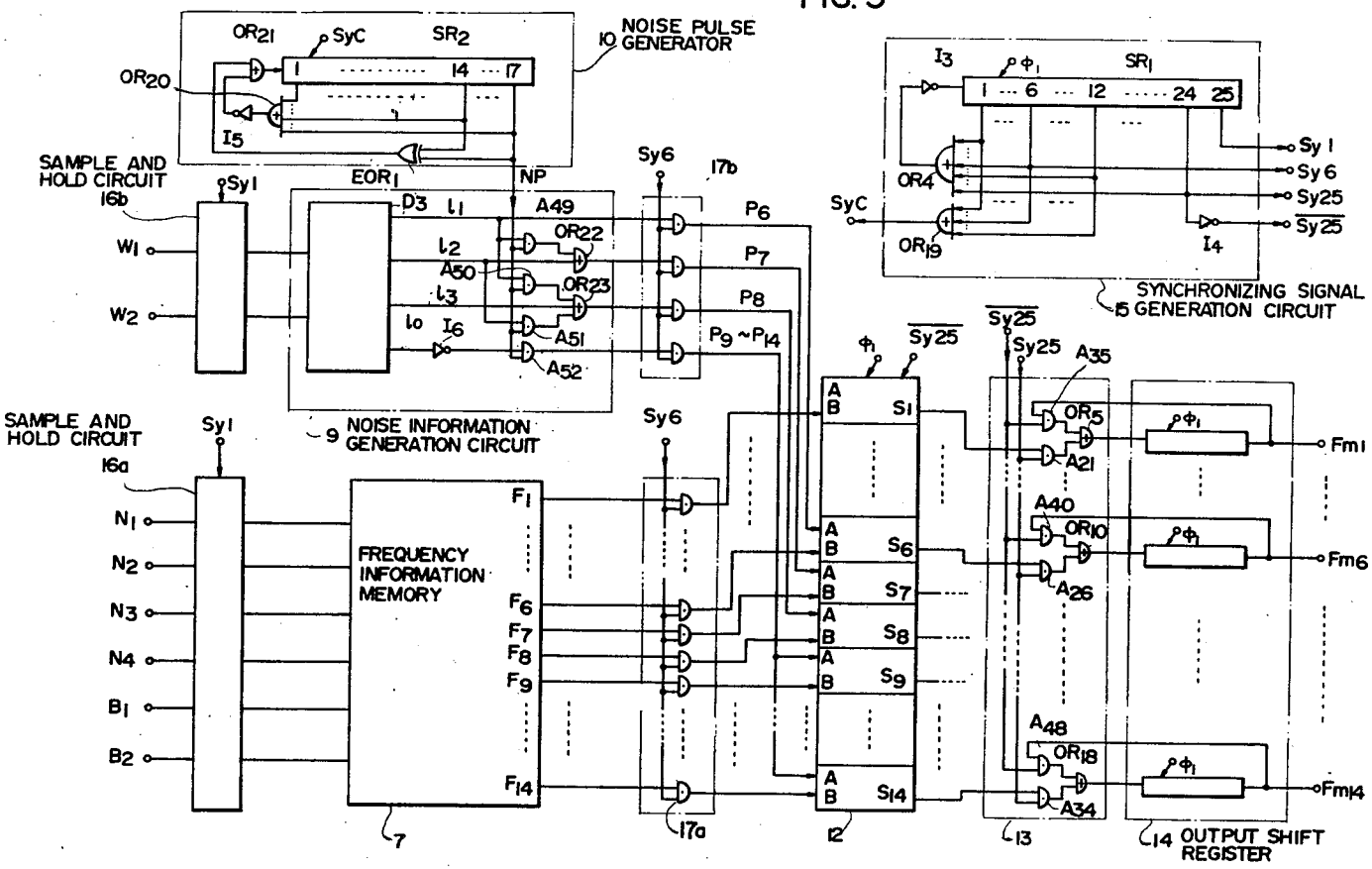
FIG. 5 is a block diagram showing in detail a frequency information generator 4 shown in FIG. 1.

FIG. 5 shows an example of the frequency information generator 4. In this example, an adder 12 is employed as a calculating device.

The frequency information memory 7 stores frequency information corresponding to the respective key address codes and produces frequency information $F_1$–$F_{14}$ for a particular key address code (a combination selected from $N_1$, $N_2$, $N_3$, $N_4$, $B_1$ and $B_2$) when this key address code is applied thereto.

The basic frequency information to be stored consists of a suitable number of bits, e.g., 14 as in the present embodiment. One bit of the most significant digit represents an integer section and the rest of the bits, i.e. 13, represent a fraction section. The following Table I illustrates example of the frequency information corresponding to the key address codes of Key $C_1$–$C_5$, $D_5$ #, $E_5$ and $C_6$. In the table, the F- number represents the frequency information $F_1$–$F_{14}$ expressed in a decimal notation, with the most significant digit $F_{14}$ being placed in the integer section.

Table I

| Key | Integer section 14 | Basic frequency information $F_1 - F_{14}$ Fraction section 13 | 12 | 11 | 10 | 9 | 8 | 7 | 6 | 5 | 4 | 3 | 2 | 1 | F-number |
|---|---|---|---|---|---|---|---|---|---|---|---|---|---|---|---|
| $C_1$ | 0 | 0 | 0 | 0 | 0 | 1 | 1 | 0 | 1 | 0 | 1 | 1 | 0 | 0 | 0.052325 |
| $C_2$ | 0 | 0 | 0 | 0 | 1 | 1 | 0 | 1 | 0 | 1 | 1 | 0 | 0 | 1 | 0.104650 |
| $C_3$ | 0 | 0 | 0 | 1 | 1 | 0 | 1 | 0 | 1 | 1 | 0 | 0 | 1 | 0 | 0.209300 |
| $C_4$ | 0 | 0 | 1 | 1 | 0 | 1 | 0 | 1 | 1 | 0 | 0 | 1 | 0 | 1 | 0.418600 |
| $C_5$ | 0 | 1 | 1 | 0 | 1 | 0 | 1 | 1 | 0 | 0 | 1 | 0 | 1 | 0 | 0.837200 |
| $D_5$# | 0 | 1 | 1 | 1 | 1 | 1 | 1 | 1 | 0 | 1 | 1 | 1 | 0 | 0 | 0.995600 |
| $E_5$ | 1 | 0 | 0 | 0 | 0 | 1 | 1 | 1 | 0 | 0 | 0 | 0 | 0 | 0 | 1.054808 |
| $C_6$ | 1 | 1 | 0 | 1 | 0 | 1 | 1 | 0 | 0 | 1 | 0 | 1 | 0 | 0 | 1.674400 |

The basic frequency information is established at a value corresponding to a musical tone of a nominal pitch which has not been frequency-modulated by noise. Assume that sampled amplitudes of one period of musical tone waveshape are stored in the musical tone waveshape memory 6 with a sampling number $n = 64$. If the frequency of a musical tone to be reproduced is represented by $f$(Hz), the F-number designating the basic frequency information is represented by the following equation (1). If one key time is a ($\mu$s), the number of times per second F is counted in the frequency counters *5a–5c* is ½ × 106, $$F = f \times 64 \times a \times 10^{-6} \quad (1)$$

This frequency information F is stored in the memory 7 in correspondence to the frequency $f$ of a note to be reproduced. This is the basic frequency $F_1$–$F_{14}$ shown in Table I.

The frequency information $F_1$–$F_{14}$ read from the frequency information memory 7 is applied to the adder 12 as summand. On the other hand, noise information $P_6$–$P_{14}$ is applied from the noise information generation circuit 9 as addend.

The noise information generation circuit 9 is constructed in such a manner that a maximum frequency difference of ± 18 Hz will be given to the basic frequency of a musical tone to be reproduced.

Generation of a noise pulse NP will now be described.

As the noise pulse generator 10, a conventional maximum length counter is employed. The maximum length counter randomly produces a pulse of a certain pulse width and comprises a 17 bit one-input-parallel-output type shift register $SR_2$, an OR circuit $OR_{20}$ to which outputs of all stages of the shift register $SR_2$ are applied, an inverter $I_5$ to which the output of the OR circuit $OR_{20}$ is applied, an exclusive OR circuit $EOR_1$ to which the output of the fourteenth and seventeenth bits of the shift register $SR_2$ are applied and an OR circuit $OR_{21}$ to which the outputs of the inverter $I_5$ and the exclusive OR circuit $EOR_1$ are applied and the output terminal of which is connected to the input terminal of the shift register $SR_2$. The output of the seventeenth bit of the shift register $SR_2$ is delivered out as the noise pulse NP.

Figure 6:
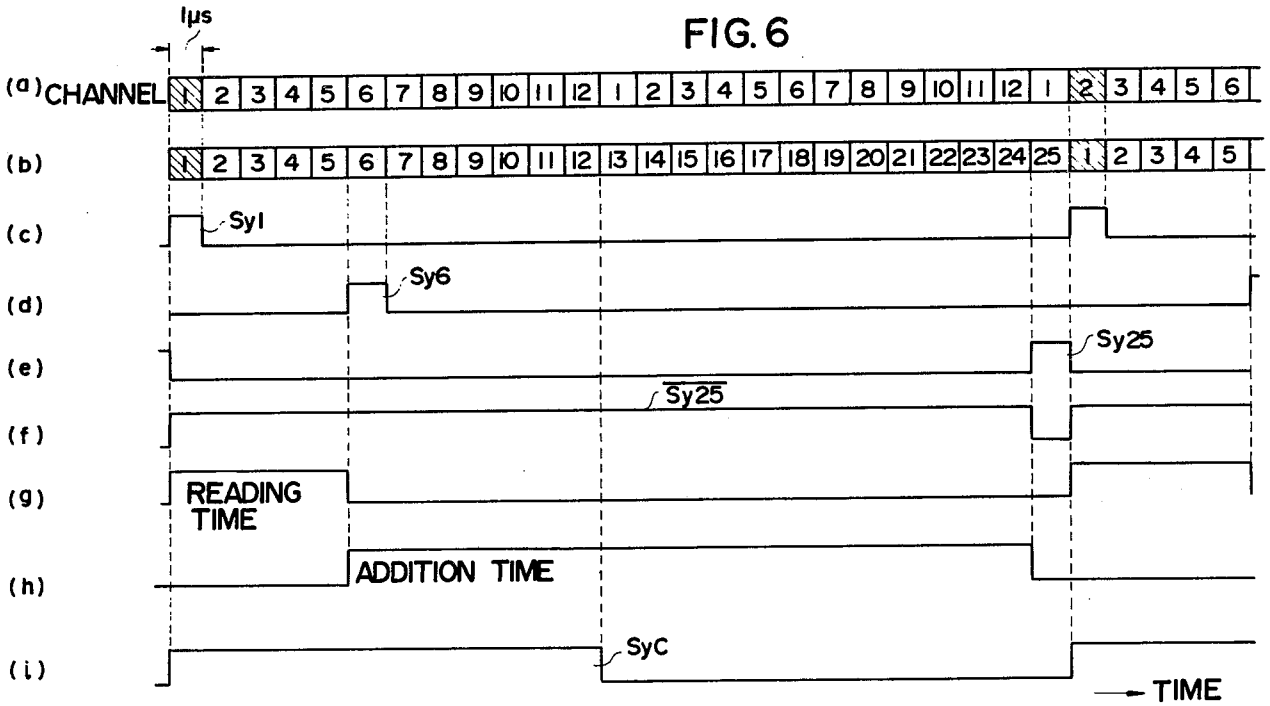
FIG. 6(*a*) through 6(*h*) are timing charts illustrative of signals at respective parts of the frequency information generator shown in FIG. 5.

A period of a pulse train produced from the maximum length counter of the above described construction is known to be $(2^{17} - 1)$ (i.e. number of shifting) multiplied by time required for one shifting. The period of generation of a shift pulse SyC for the shift register $SR_2$ is 25 $\mu$s as shown in FIG. 6(*i*). Accordingly, a period of a pulse train of the same pattern provided at the output terminal is $(2^{17} - 1) \times 25 \times 10^{-6} \approx 3.277$ (sec). In case a signal of the same pattern is repeatedly produced with a period of 1 to 2 seconds, such a signal can hardly be perceived as a noise to human hearing. If, however, the signal is repeated with a period of the order of 3 seconds, the periodicity of the signal is hardly perceived, so that the noise pulse NP substantially is produced randomly. In addition, since the noise pulse is produced for 12 tones in a time sharing manner, the period of the noise pulse NP for one channel (one tone) is 3.277 × 12 (sec.). It will be apparent that periodicity of such a signal will not be perceived at all. The pulse width of the noise pulse is 25 $\mu$s. The pulse width of the shift pulse SyC can be made relatively long and, accordingly, a shift register operating at a low speed will suffice as the shift register $SR_2$. This contributes to compactness and low manufacturing cost of the instrument. The construction of the noise pulse generator 10 is not limited to the above described one but any device that can produce the noise pulse NP randomly may be employed as the noise pulse generator 10.

The noise pulse NP is supplied to the noise information generation circuit 9 in which first noise information or second noise information is produced in accordance with application or non-application (1, 0) of the noise pulse NP.

The noise information generation circuit 9 comprises a decoder $D_3$ which decodes a 2 bit depth signal $W_1$, $W_2$ and a logical circuit which generates the first or second noise information $P_6$–$P_{14}$ in response to the noise pulse NP and controls the magnitude of the noise information $P_6$–$P_{14}$ in accordance with the decoded depth signal $W_1$, $W_2$.

The noise information $P_6$–$P_{14}$ can be controlled in a suitable number of stages, e.g. 4 as in the present embodiment, according to the contents of the depth signal $W_1$, $W_2$. In the present embodiment, it is assumed that the depth signal $W_2$, $W_1$ represents "depth 0", a state in which no frequency modulation is applied when the depth signal $W_2$, $W_1$ is 00, "depth 1" when it is 01, "depth 2" when it is 10, and "depth 3" when it is 11, the degree of depth increasing stepwisely (i.e. the value of the noise information $P_6$–$P_{14}$ increasing stepwisely).

The depth signal generator 11 comprises an operator (not shown) for establishing a desired depth signal $W_2$, $W_1$ and a matrix circuit for converting a signal sent from the operator into the depth signal $W_2$, $W_1$. In case the noise modulation is desired separately for each keyboard, the operator and the matrix circuit are provided for each keyboard and, in addition thereto, a data select circuit is provided for selectively outputting the depth signal $W_1$, $W_2$ established for the respective keyboards in response to the keyboard code $K_1K_2$ applied from the key assigner 3.

The decoder $D_3$ produces a signal 1 on an output line $l_0$ when the depth signal $W_2$, $W_1$ is 00, a signal 1 on an output line $l_1$ when the depth signal $W_2$,$W_1$ is 01, a signal 1 on an output line $l_2$ when the depth signal $W_2$, $W_1$ is 10, and a signal 1 on an output line $l_3$ when the depth signal $W_2$, $W_1$ is 11. The signal on the output line $l_0$ is applied to one of the input terminals of an AND circuit $A_{52}$ via an inverter $I_6$, and the signal on the output line $l_1$ to one of the input terminals of each of AND circuits $A_{49}$ and $A_{50}$. The signal on the output line $l_2$ is applied to an OR circuit $OR_{22}$ and also to one of the input terminals of an AND circuit $A_{51}$. The signal on the output line $l_3$ is applied directly to an OR circuit $OR_{23}$. The noise pulse NP is applied to the other input terminals of the AND circuits $A_{49}$–$A_{52}$. The output of the AND circuit $A_{49}$ is applied to the OR circuit $OR_{22}$ and the outputs of the AND circuits $A_{50}$ and $A_{51}$ are applied to the OR circuit $OR_{23}$.

According to the above described construction, the signal on the output line $l_1$ is provided at the least significant digit $P_6$ of the noise information $P_6$–$P_{14}$. The output of the OR circuit $OR_{22}$ is provided at the second digit $P_7$ and the output of the OR circuit $OR_{23}$ at the third digit $P_8$. The output of the AND circuit $A_{52}$ is provided at the fourth to the most significant digits $P_9$–$P_{14}$. The values of the noise information $P_6$–$P_{14}$ produced in response to the depth signal $W_2$, $W_1$ and the noise pulse NP are shown, by way of example, in Table II.

Table II

| Depth signal Depth | $W_2W_1$ | Noise pulse NP | Noise information $P_{14}$ | $P_{13}$ | $P_{12}$ | $P_{11}$ | $P_{10}$ | $P_9$ | $P_8$ | $P_7$ | $P_6$ |
|---|---|---|---|---|---|---|---|---|---|---|---|
| 0 | 0 0 | 0 | 0 | 0 | 0 | 0 | 0 | 0 | 0 | 0 | 0 |
| | | 1 | 0 | 0 | 0 | 0 | 0 | 0 | 0 | 0 | 0 |
| 1 | 0 1 | 0 | 0 | 0 | 0 | 0 | 0 | 0 | 0 | 0 | 1 |
| | | 1 | 1 | 1 | 1 | 1 | 1 | 1 | 1 | 1 | 1 |
| 2 | 1 0 | 0 | 0 | 0 | 0 | 0 | 0 | 0 | 0 | 1 | 0 |
| | | 1 | 1 | 1 | 1 | 1 | 1 | 1 | 1 | 1 | 0 |
| 3 | 1 1 | 0 | 0 | 0 | 0 | 0 | 0 | 0 | 1 | 0 | 0 |
| | | 1 | 1 | 1 | 1 | 1 | 1 | 1 | 1 | 0 | 0 |

Generation of the noise information will be explained taking "depth 3" in Table II for example. When no noise pulse NP is produced (signal 0), the AND circuits $A_{49}$–$A_{52}$ are not enabled. Since at this time the signal 1 on the output line $l_3$ is applied to the OR circuit $OR_{23}$, the OR circuit $OR_{23}$ only produces a singal 1. Accordingly, the contents of the eighth digit $P_8$ only is 1 and the contents of the rest of the digits are all 0. When the noise pulse NP is produced (signal 1), and AND circuit $A_{52}$ is enabled so that the AND circuit 52 and the OR circuit $OR_{23}$ produce the outputs 1. Accordingly, the contents of the digits $P_8$–$P_{14}$ are 1 and the contents of the digits $P_7$ and $P_6$ are 0. The noise information $P_6$ - $P_{14}$ which is produced when no noise pulse NP is generated (signal 0) is made, for example, the first noise information and the noise information $P_6$ - $P_{14}$ which is produced when the noise pulse NP is generated (signal 1) is made the second nose information.

In the above described manner, the first or second noise information is produced according to application or non-application of the noise pulse NP.

The first noise information at the depth 3 expressed in a decimal notation with the most significant digit $P_{14}$ being placed at the order of 1 is approximately 0.0156. Since the noise information is represented by a frequency difference $\Delta F$ as has previously been described, F and $f$ in the equation (1) can be replaced by $\Delta F$ and $\Delta f$. Then, $$0.0156 = 64 \times \Delta f \times a \times 10^{-6} \qquad (2)$$

If $a \times 64 \times 10^{-6}$ is 0.00086356, $\Delta f = 0.0156 \div 0.00086365 \approx 18$. That is, a frequency difference in the order of about 18 Hz has been given by the first noise information. On the other hand, the second noise information gives a frequency difference of about −18Hz to the basic frequency was well be described later.

It will be readily understood from Table II that somewhat smaller values of frequency differences are given in the case of "depth 2" and "depth 1" than in the case of "depth 3".

Figure 7:
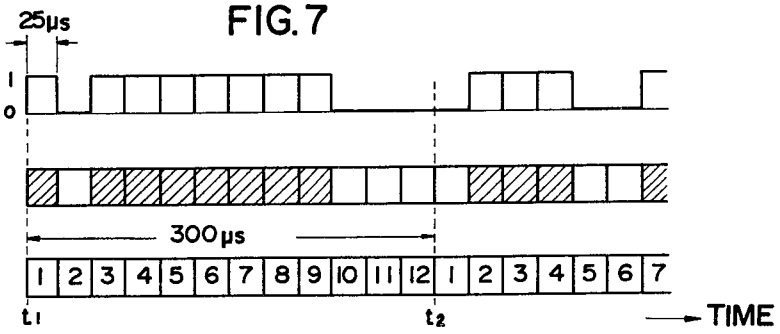
FIGS. 7(*a*) through 7(*c*) are timing charts illustrative of states of noise information corresponding to generation of a noise pulse.
Figure 8:
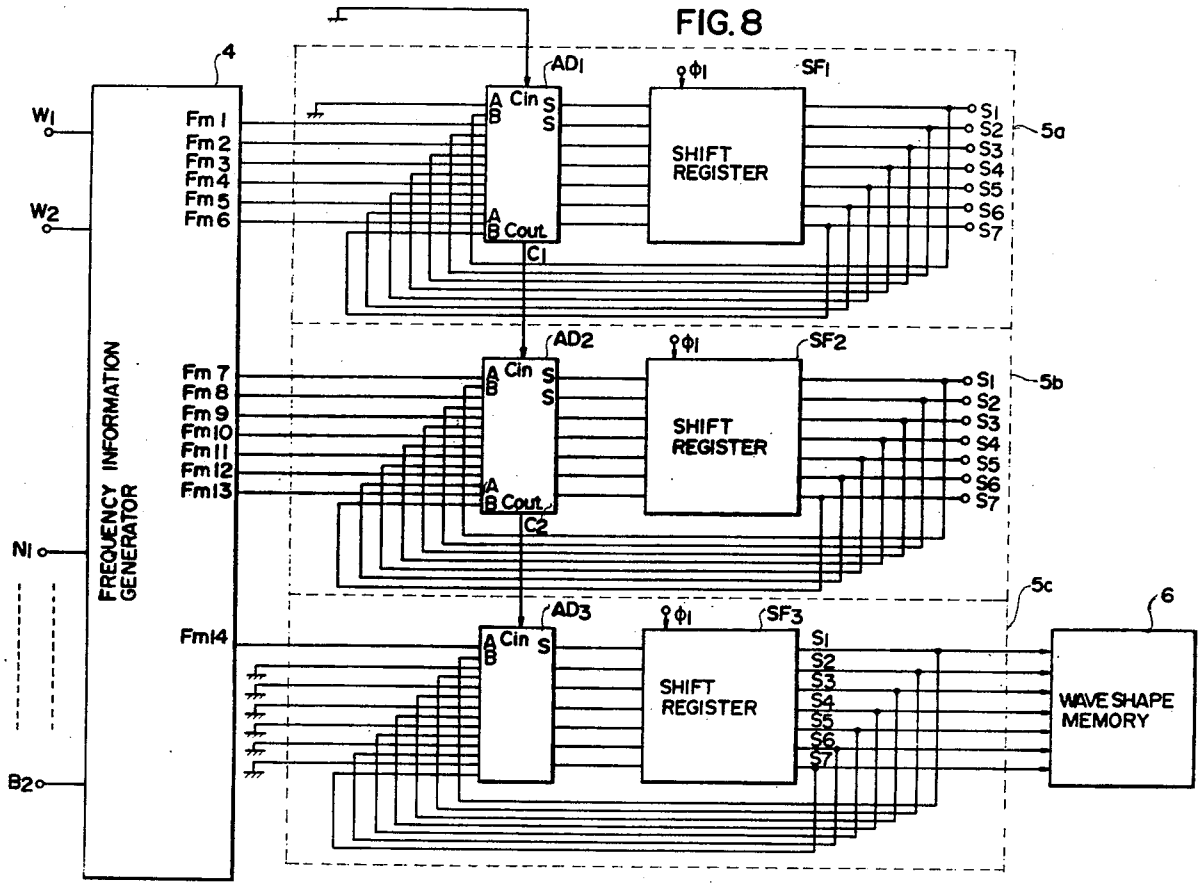
FIG. 8 is a circuit diagram showing a detailed circuit of fraction and integer counters shown in FIG. 1.

Assume that the noise pulse NP is randomly produced as shown in FIG. 7(*a*). The first noise information is sequentially produced as shown by unshadowed portions and the second noise information as shown by shadowed portions in FIG. 7(*b*).

Any conventional digital type adder may be employed as the adder 12. In the present embodiment, a parallel type adder which receives at input terminals B the basic frequency information $F_1$–$F_{14}$ from the memory 7 as summand and, at input terminals A from the sixth to the most significant digits, the noise information $P_6$–$P_{14}$ from the noise information generator 9 as addend. A register for temporarily storing the output of each digit of the adder 12 and a register for temporarily storing (for 1 $\mu$s) a carry signal may be additionally provided. In this latter case, an intermediate result of addition in the first register is circulatingly input to the adder 12 every 1 $\mu$s in response to the main clock pulse $\phi_1$ and is added to the carry signal applied from the second register. The result of addition $S_1$–$S_{14}$ is applied to an output shift register 14 via a gate circuit 13.

Assuming that the frequency information $F_1$–$F_{14}$ of the note $C_4$ is provided by the memory 7, the calculating operation of the adder 12 will be described. If the depth signal $W_1$, $W_2$ is "depth 3" and the first noise information is generated, a value obtained by adding the first noise information to the basic frequency information $F_1$–$F_{14}$ as shown in Table III is produced as the result of addition $S_1$–$S_{14}$.

Table III

| | | | | | | | | | | |
|---|---|---|---|---|---|---|---|---|---|---|
| | Addend | 0 | 0 | 0 | 0 | 0 | 0 | 1 | 0 | 0 ... |
| NP=0 | Summand | 0 | 0 | 1 | 1 | 0 | 1 | 0 | 1 | 1 ... |
| | Result of addition | 0 | 0 | 1 | 1 | 0 | 1 | 1 | 1 | 1 ... |
| | Digit | 14 | 13 | 12 | 11 | 10 | 9 | 8 | 7 | 6 |
| | Addend | 1 | 1 | 1 | 1 | 1 | 1 | 1 | 0 | 0 ... |
| NP=1 | Summand | 0 | 0 | 1 | 1 | 0 | 1 | 0 | 1 | 1 ... |
| | Result of addition | 0 | 0 | 1 | 1 | 0 | 0 | 1 | 1 | 1 ... |

When the second noise information is produced (NP = 1), a carry signal from the fourteenth, i.e. the most significant, digit to a fifteenth digit is cancelled in the overflow state. Accordingly, a value which is substantially obtained by subtracting the first noise information from the basic frequency information is produced as the result of addition $S_1$–$S_{14}$.

Accordingly, the frequency-modulation is conducted in such a manner that a frequency difference of 18 Hz is added to the basic frequency in the case where the first noise information is produced, whereas the frequency difference of 18 Hz is subtracted from the basic frequency in the case where the second noise information is produced. The frequency information $Fm_1$–$Fm_{14}$ which has been frequencymodulated in the above described manner is produced from the adder 12.

In constructing the frequency information generator 4, operation time of the frequency information memory 7 constructed of a suitable conventional memory such as a read-only memory as well as time required for addition in the adder 12 must be taken into consideration. For achieving an accurate operation it is indispensable that time required for addition by synchronized with the operation of the entire system. According to the invention, a synchronizing signal generation circuit 15 is provided for synchronization between the component parts of the system.

Assume now that a maximum number of musical tones to be reproduced simultaneously is 12. The synchronizing signal generation circuit 15 comprises a one-input-parallel-output type shift register $SR_1$ with 25 bits, an OR gate $OR_4$ receiving outputs of the first to the 24th bits of the shift register $SR_1$ and inverters $I_3$ and $I_4$. The contents in the shift register $SR_1$ are shifted by the clock pulse $\phi_1$ every 1 $\mu$s and the output from the 5th bit is used as a synchronizing pulse Sy 6, the one from the 24th bit as a synchronizing pulse Sy 25 and the one from the 25th bit as a synchronizing pulse Sy 1 respectively. Relationship between the respective pulses Sy 1, Sy 6, Sy 25, $\overline{Sy\ 25}$ are illustrated in FIGS. 6 (C) through 6 (*f*). FIG. 6 (*a*) shows the channel time. The outputs of the first to the twelfth bits are applied to an OR circuit $OR_{19}$ the output of which is applied to the noise pulse generator 10 as the shift pulse Sy C as shown in FIG. 6(*i*).

A sample and hold circuit 16a holds the key address code $N_1$ - $B_2$ in storage during a pulse period of the synchronizing pulse Sy 1 (i.e. 25 $\mu$s) and supplies the key address code to the frequency information memory 7 until application of a next pulse Sy 1. A sample hold circuit 16*b* likewise holds the depth signal $W_1$, $W_2$ from the depth signal generator 11 in storage during the pulse period of the synchronizing pulse Sy 1 and supplies the depth signal $W_1$, $W_2$ to the noise information generation circuit 9 until application of a next pulse Sy 1.

A first gate circuit 17*a* is composed of a plurality of AND circuits each of which receives, at one input thereof, a corresponding one of the bits outputs $F_1$–$F_{14}$ of the frequency information memory 7 and, at the other input thereof, the synchronizing pulse Sy 6. A second gate circuit 17*b* is likewise composed of a plurality of AND circuits each of which receives, at one input thereof, a corresponding one of the bit outputs $P_6$–$P_{14}$ of the noise information generation circuit 9. These gate circuits 17*a* and 17*b* supply, upon application thereto of the synchronizing pulse Sy 6, the frequency information $F_1$–$F_{14}$ and the noise information $P_6$–$P_{14}$ to the adder 12 respectively as summand inputs and addend inputs. Since the interval between the synchronizing pulses Sy 1 and Sy 6 is 5 $\mu$s, reading of the memory 7 may be completed within 5 $\mu$s as shown in FIG. 6(*g*). Accordingly, the operation time of the memory 7 is sufficiently secured. Further, a read-only memory of a low speed may sufficiently be employed as the memory 7 so that the memory 7 may be made very compact and manufactured at a low cost.

A third gate circuit 13 comprises AND circuits $A_{21}$–$A_{34}$ each of which receives at one input thereof a corresponding bit output of the adder 12 and at the other input thereof the synchronizing pulse Sy 25, AND circuits $A_{35}$–$A_{48}$ each of which receives at one input thereof a bit output from the final stage of a corresponding shift register of the output shift register group 14 and, at the other input thereof, the signal $\overline{Sy\ 25}$ which is of an opposite polarity to the synchronizing pulse Sy 25, and OR circuits $OR_5$–$OR_{18}$ each of which receives the outputs of corresponding ones among the AND circuits $A_{21}$–$A_{34}$ and $A_{35}$–$A_{48}$. When the third gate circuit 13 receives the synchronizing pulse Sy 25, it applies signals $S_1$–$S_{14}$ representing the results of the addition conducted in the adder 12 (i.e. the frequency information $F_{m1}$–$F_{m14}$ which has been frequency-modulated by the noise) to the respective inputs of the shift register of the output shift register group 14. When the synchronizing pulse Sy 25 is not applied to the third gate circuit, the output data of the shift register group 14 is circulated.

Since interval between the synchronizing pulses Sy 6 and Sy 25 is 19 $\mu$s as shown in FIG. 6 (*h*), the operation of the adder 12 is sufficiently secured. The signal $\overline{Sy\ 25}$ is provided for resetting the result of addition.

Each shift register of the output shift register group 14 has 12 words (each word consisting of 14 bits) and is successively shifted by the clock pulse $\phi_1$. The output shift register group 14 is provided for outputting the result of addition $S_1$–$S_{14}$ for a plurality of channels in a time sharing sequence manner. As shown in FIG. 6(*a*) which illustrates the respective channel times and FIG. 6(*b*) which illustrates a period of generation of the synchronizing pulses, the key address code $N_1$ - $B_2$ and the depth signal $W_1$, $W_2$ are respectively stored in the sample hold circuits 16*a* and 16*b* in the order of the first channel, second channel . . . every time the synchronizing pulse Sy 1 is applied to these sample hold circuits 16*a* and 16*b*. In response to this, the result of addition for each channel (i.e. each key or tone) conducted in the adder 12 is sequentially output therefrom with an interval of 25 $\mu$s per channel.

FIG. 7(*c* ) shows timing of the result of addition for each channel produced by the adder 12. It takes 300 $\mu$s before the results of the addition for all of the 12 channels have been output from the adder 12. Accordingly, the output of the final stage of each of the output shift register group 14 is fed back and the data for a particular channel is circulated every one key time for enabling the shift register group 14 to supply every one key time the result of addition $S_1$–$S_{14}$ for the particular channel to the frequency counters 5*a*–5*c* as the frequency information $F_{m1}$–$F_{m14}$ which has been frequency modulated. New data is stored in the particular channel every 300 $\mu$s.

Taking the first channel for example in FIGS. 7(*b*) and 7(*c*), second frequency information $F_{m1}$–$F_{m14}$ (i.e. frequency information corresponding to a frequency which is 18 Hz lower than the basic frequency in the case of "depth 3") which has been frequency-modulated by the second noise information (the shadowed portion) starts to be produced at a time point $t_1$ and is supplied to the frequency counters 5*a*–5*c* 25 times with a period of 12 $\mu$s during 300 $\mu$s. From a time point $t_2$, first frequency information $F_{m1}$–$F_{m14}$ (i.e. frequency information corresponding to a frequency which is 18 Hz higher than the basic frequency in the case of "depth 3") which has been frequency-modulated by the first noise information (the unshadowed portion) is supplied in like manner to the frequency counters 5*a*–5*c*.

Whether the basic frequency information is frequency-modulated by the first noise information or the second noise information is determined at random. Statistically, the probability that the basic frequency information is frequency-modulated by the first or second noise information is 50%, i.e. even.

IV. Generation of a musical tone waveshape

The least significant digit up to the sixth digit of the frequency information $F_{m1}$–$F_{m14}$ are applied from the output shift register group 14 to the fraction counter 5*a*, those from the seventh digit up to the thirteenth digit to the fraction counter 5*b*, and the most significant digit to the integer counter 5*c* respectively.

Figure 9:
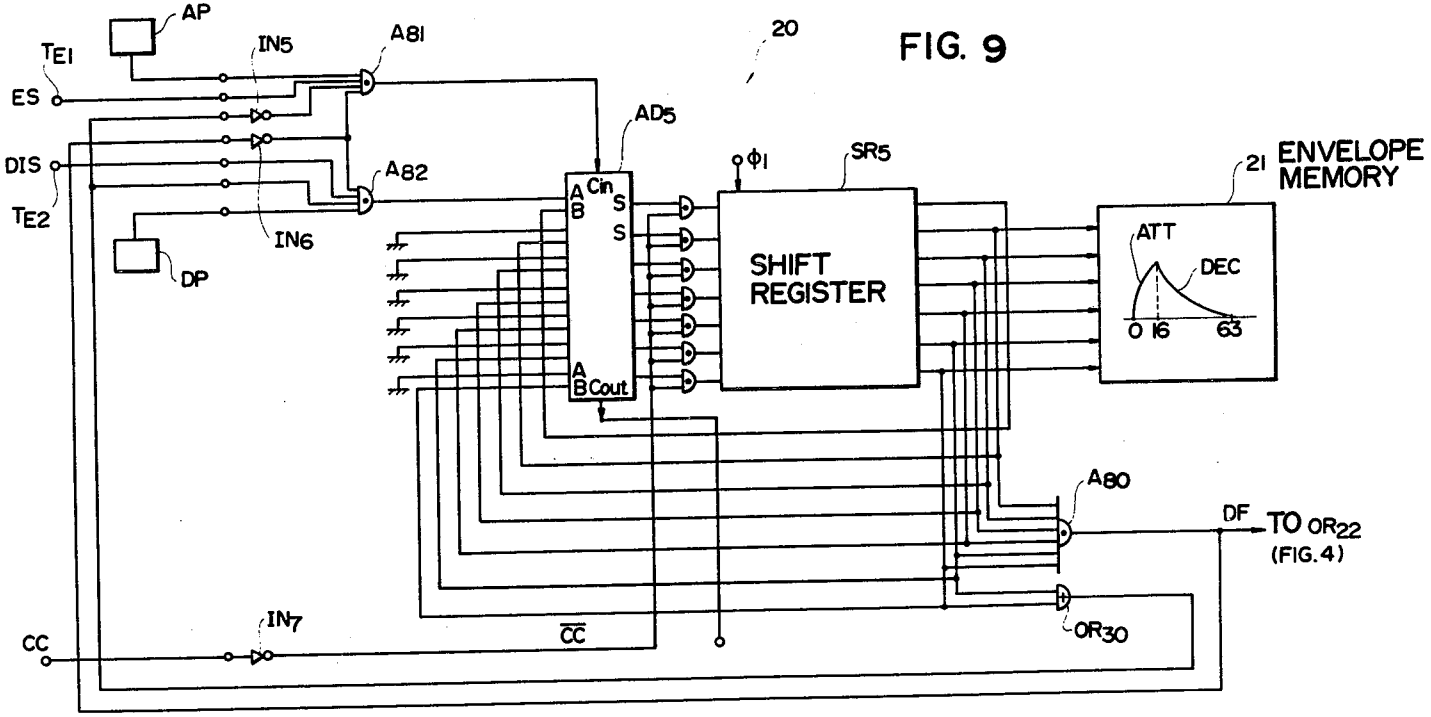
FIG. 9 is a block diagram showing in detail an envelope counter 20 shown in FIG. 1.

The counters 5*a*–5*c* comprise adders $AD_1$–$AD_3$ and shift registers $SF_1$–$SF_3$ as shown in FIG. 9. Each of the adder $AD_1$–$AD_3$ adds the output from the corresponding one of the shift register $SF_1$–$SF_3$ to the output of the output shift register group 14. The shift registers $SF_1$–$SF_3$ are adapted to store the 12 kinds of outputs in time sequence from the adders $AD_1$–$AD_3$ temporarily and feed them back to the input side of the adders $AD_1$–$AD_3$. The shift register $SF_1$–$SF_3$ respectively have the same number of stages as the maximum number of musical tones to be reproduced simultaneously, e.g. 12 as in the present embodiment. This is an arrangement made for operating the frequency counters in a time-sharing sequence manner, since the frequency information memory 4 receives in time sharing the key address codes stored in the 12 channels (shift register stages) of the key address code memory KAM and produces the frequency information for the respective channels.

Explanation will now be made about this arrangement with respect to the first channel. If the contents of the first channel of the shift register $SF_1$ of the fraction counter 5*a* are 0, frequency information signals $F_{m1}$ through $F_{m6}$ i.e. the first 6 bits of the fraction section are initally stored in the first channel of the shift register $SF_1$. After a lapse of one key time, new frequency information signals $F_{m1}$ through $F_{m6}$ are added to the contents already stored in the first channel. This addition is repeated at every key time and the signals $F_{m1}$ through $F_{m6}$ are cumulatively added to the stored contents. When a carry takes place in the addition, a carry signal $C_1$ is applied from the counter 5*a* to the next counter 5*b*. The fraction counter 5*b* consisting of the adder $AD_2$ and the shift register $SF_2$ likewise makes cumulative addition of frequency information signals $F_{m6}$ through $F_{m13}$ i.e. the next 7 bits of the fraction section, and the carry signal $C_1$ applying a carry signal $C_2$ to the adder $AD_3$ when a carry takes place as a result of the addition. The integer counter 5*c* consisting of the adder $AD_3$ and the shift register $SF_3$ receives the single digit $F_{m14}$ and the carry signal $C_2$ from the adder $AD_2$ and makes cumulative addition in the same manner as has been described with respect to the fraction counters 5*a* and 5*b*. The integer outputs of 7 bits stored in the first channel of the shift register $SF_3$ are successively applied to the musical tone waveshape memory 6 for designating the reading addresses to read. If one period of a musical tone waveshape to be reproduced is stored in the form of sample points with a sampling manner $n = 64$, the integer counter 5*c* is composed in such a manner that it has 64 stages and reading of said one period of waveshape is completed when a cumulative value of the frequency information $F_{m1}$–$F_{m14}$ has amounted to 64.

Since the noise information $P_6$–$P_{14}$ is not produced when the depth signal $W_2$, $W_1$ is 00, the basic frequency information $F_1$–$F_{14}$ is directly applied to the counters 5*a*–5*c*. The speed of increase of the cumulative value in the counters 5*a*–5*c* therefore is constant, and the period of reading of the musical tone waveshape memory 6 is also constant. Accordingly, a musical tone waveshape corresponding to the basic frequency without any frequency-modulation by the noise information is produced.

If the first or second noise information is randomly produced, reading of a waveshape from the memory 6 changes accordingly. In the case where reading is effected by the cumulative value of the frequency information $F_{m1}$–$F_{m14}$ which has been frequency-modulated by the first noise information, a musical tone waveshape corresponding to a frequency $f_1$ which is higher than the basic frequency by a predetermined frequency difference (18 Hz in "depth 3") is produced. In the case where reading is effected by the cumulative value of the frequency information $F_{m1}$–$F_{m14}$ which has been frequency-modulated by the second noise information, a musical tone waveshape corresponding to a frequency $f_2$ which is lower than the basic frequency by the predetermined frequency difference (18 Hz in "depth 3") is produced.

Since the first and second noise information is randomly produced, the frequency of a reproduced musical tone randomly deviates to either one of the frequencies $f_1$ and $f_2$. This produces a unique musical tone resembling a husky voice. The pitch of the musical tone produced in this manner which human hearing can perceive is equal to a mean value of the frequencies $f_1$ and $f_2$, i.e. the pitch of the basic frequency, because the probability that the first or second noise information is produced is 50% as has previously been described. Accordingly, a pleasant husky tone having the nominal pitch of a selected note is reproduced.

In the above described embodiment, the adder 12 is employed as the calculating device 8. The calculating device 8 is not limited to this but a device may be employed such that the second noise information is represented as a complement of the first noise information and an addition and subtraction circuit is employed to conduct calculation of complements. In this case, the noise information must be represented as a ratio to the basic frequency information $F_1$–$F_{14}$.

V. Generation of an envelope waveshape

The waveshape of a musical tone is read from the musical tone waveshape memory as has been described above. The entire level of the musical tone is controlled by the output of the envelope memory 21. Reading of an envelope waveshape from the envelope memory 21 is controlled by the envelope counter 20. Reading of the envelope waveshape will now be described with reference to FIG. 9.

FIG. 9 illustrates one example of the envelope counter 20. The envelope counter 20 comprises an adder $AD_5$ and a 12 word 7 bit shift register $SR_5$, the result of addition in the adder $AD_5$ being supplied every 1 key time to corresponding channels of the shift register $SR_5$. More specifcally, the adder $AD_5$ adds the output of the shift register $SR_5$ and the clock pulse and provides a result S to the input terminal of the shift register $SR_5$ thereby causing the envelope counter 20 to successively effect a cumulative counting with respect to each of the channels.

An output representing a counted value is applied from this envelope counter 20 to an envelope memory 21 and a waveshape amplitude stored at an address corresponding to the counted value is successively read from this memory 21. The envelope memory 21 stores an attack waveform ATT at addresses starting from 0 to a predetermined address, e.g. 16, and a decay wave form DEC at addresses from the next address to the last one, e.g. 63.

The counting operation of the envelope counter will now be described with espect to the first channel.

When the attack start signal ES is applied to a terminal $TE_1$, an AND circuit $A_{81}$ which has already received signals 1 obtained by inverting outputs 0 of an AND circuit $A_{80}$ and an OR circuit $OR_{30}$ respectively by inverters $IN_5$ and $IN_6$ gates out an attack clock pulses AP to the adder $AD_5$. The adder $AD_5$ and the shift register $SR_5$ successively count the attack clock pulses thereby reading out the attack waveshape ATT of the envelope memory 2. When the counted value has reached 16, an output 1 is produced from the OR circuit $OR_{30}$ and, accordingly, the attack clock pulse AP ceases to pass through the AND circuit $A_{81}$. The attack clock pulse AP remains prevented from passing the AND circuit $A_{81}$ with respect to subsequent counts. Consequently, counting is once stopped and the amplitude stored at address 16 of the envelope memory 21 comtinues to be read out. Thus, a sustain state is maintained.

In this state an AND circuit $A_{82}$ receives a signal "1" from the OR circuit $OR_{30}$ and also a signal 1 which is obtained by inverting the output 0 of the AND circuit $A_{80}$ by the inverter $IN_6$. When the decay start signal DIS is applied to a terminal $TE_2$, a decay clock pulse DP passes through the AND circuit $A_{82}$ and is applied to the adder $AD_5$. This causes the envelope counter 20 to resume the counting operation for counted values after 16 and the decay waveshape is read from the envelope memory 21. When the counted value has reached 63, all of the inputs to the AND circuit $A_{80}$ become 1 so that the AND circuit $A_{80}$ produces an output 1. Accordingly, the AND circuit $A_{82}$ ceases to gate out the decay clock pulse DP and the counting operation is stopped. Thus, the reading of the envelope waveshape has been completed.

VI. Description of another embodiment

Figure 10:
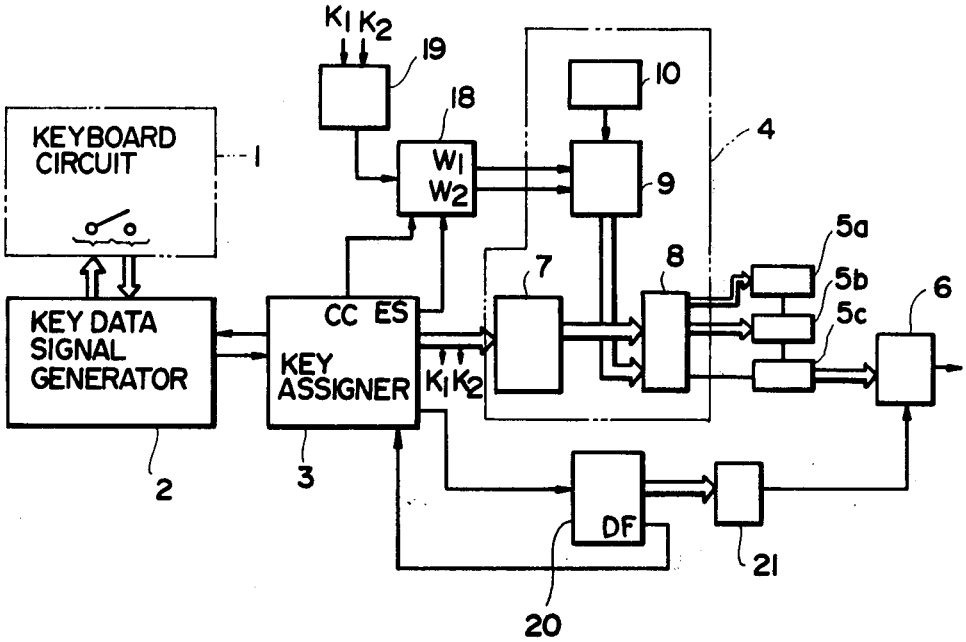
FIG. 10 is a block diagram showing another embodiment of the electronic musical instrument according to the invention, FIGS. 11(*a*) through 11(*c*) are graphic diagrams schematically showing a relation between generation of a depth signal and a stepwise change of modulation factor.

FIG. 10 shows another embodiment of the electronic musical instrument according to the invention. This embodiment is different from the above described embodiment in that the random frequency-modulation by the noise information is made only during a predetermined period of time from the start of reproduction of a musical tone and the modulation factor changes in steps from a predetermined value to zero during this period of time. In the present embodiment, the depth signal generator 11 in FIG. 1 is replaced by a depth signal generator 18 which is actuated upon depression of a key and produced stepwisely changing depth signals. The present embodiment further comprise a clock pulse generator 19 providing the depth signal generator 18 with clock pulses which differ from each other depending upon the kind of keyboard. The construction of the present embodiment is substantially the same as the embodiment shown in FIG. 1 in other respects. The following description will therefore be made mainly with reference to the different features of the present embodiment.

Figure 11:
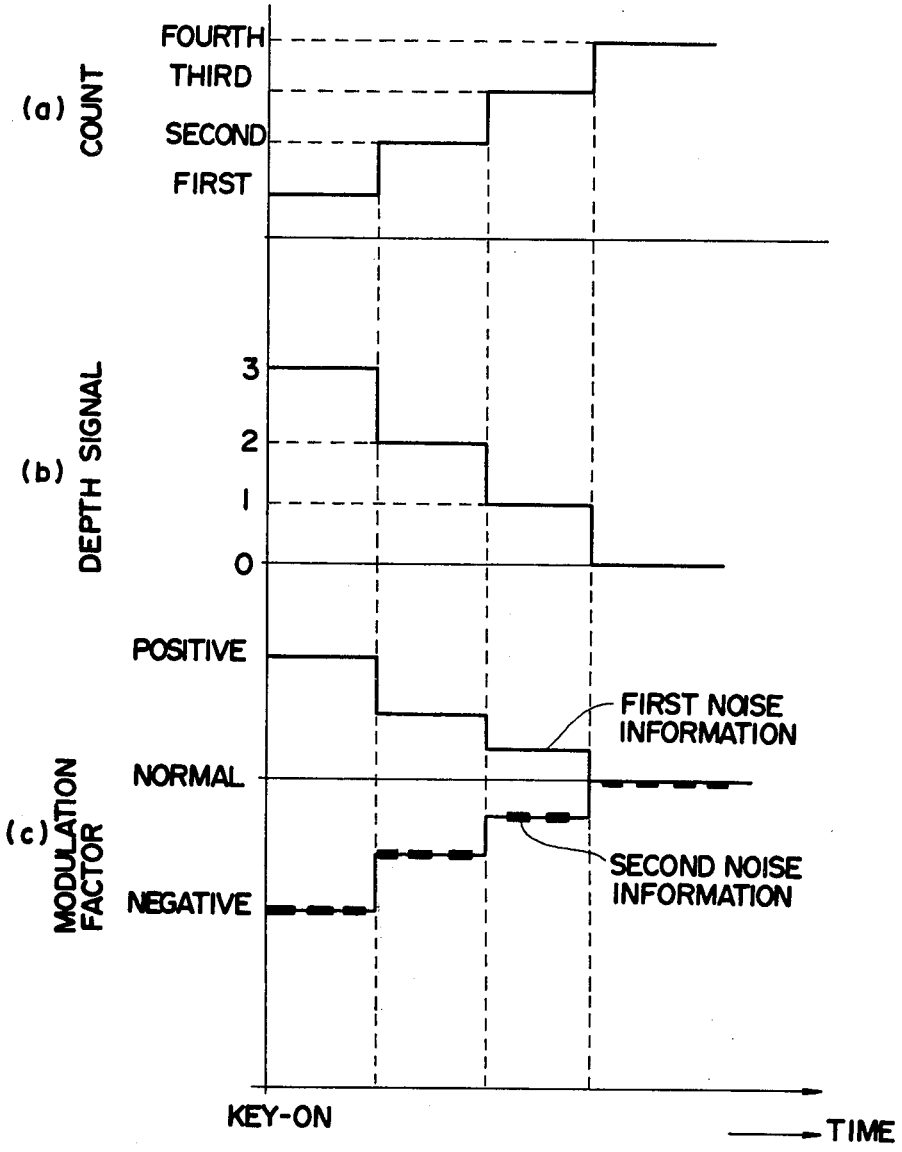

The depth signal generator 18, upon receipt of the signal ES representing key-on from the key assigner 3, start counting of a clock pulse generated by a clock pulse generation circuit 19 and produces a noise depth signal $W_1$, $W_2$the value of which decreases in steps from "depth 3"(initial state) to "depth 2", . . . as shown in FIG. 11(*b*) in accordance with predetermined count ranges I, II, III, . . . which increase in steps. This depth signal $W_1$, $W_2$ is applied to the noise information generation circuit 9 causing the absolute value of the first and second noise information to decrease stepwisely as shown in FIG. 11(*c*). Accordingly, the frequency-modulated factor of the frequency-modulated by the noise is at the maximum at the key-on and is reduced to zero after a lapse of a predetermined period of time (i.e. at "depth 0" in FIG. 11(*b*).

Figure 12:
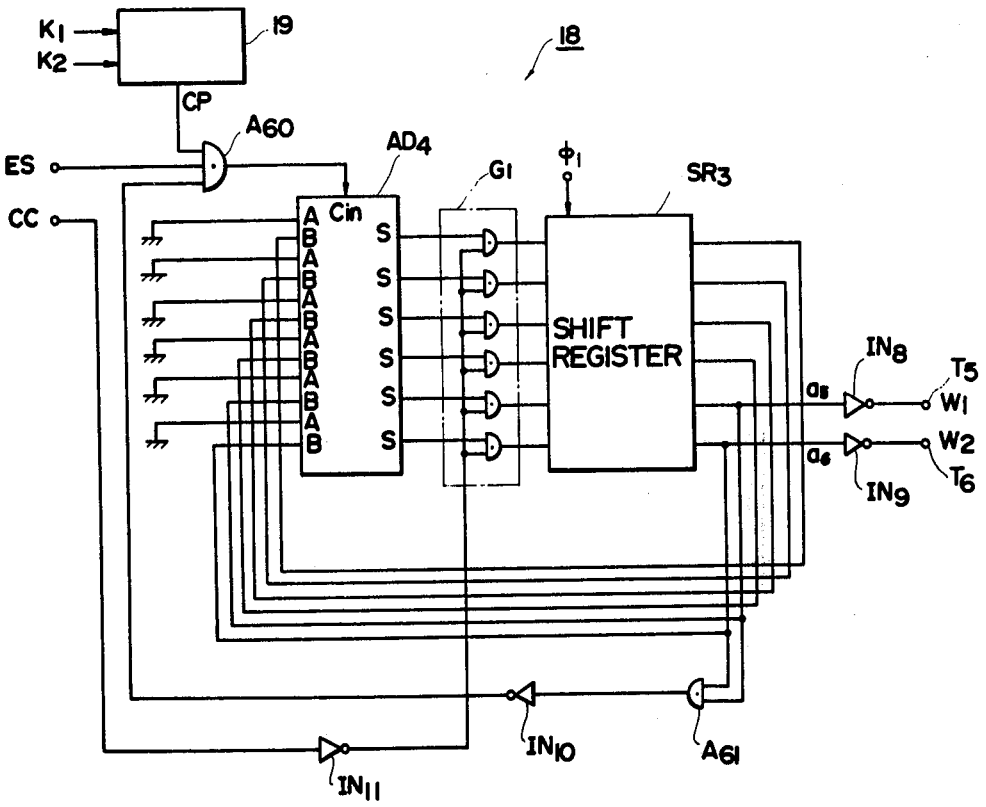
FIG. 12 is a block diagram showing in detail a depth signal generator 18 shown in FIG. 10.

Referring to FIG. 12, the depth signal generator 18 comprises an adder $AD_4$ and a 12 work-6 bit shift register $SR_3$. When the attack start signal ES is applied from the key assigner 3, the clock pulse CP from the clock selector circuit 19 is applied to the adder $AD_4$ through an AND circuit $A_{60}$ and is cumulatively added every key time for each channel. The result of the addition is applied to the particular channel of the shift register $SR_3$ via the gate circuit $G_1$. The output of the shift register $SR_3$ is fed back to an input terminal B of the adder $AD_4$ and cumulatively added therein. The output $a_6$ of the most significant digit and the output $a_5$ of the next digit of the shift register $SR_3$ are respectively applied to terminals $T_6$ and $T_5$ via inverters $IN_9$ and $IN_8$ and signals obtained by inverting the counting outputs $a_5$, $a_6$ are produced from the terminals $T_5$, $T_6$ as the depth signal $W_1$, $W_2$. An AND circuit $A_{61}$ and an inverter $IN_{10}$ are provided so as to prevent application of the clock pulse CP when the count has amounted to 48 and thereby maintain the count of 48.

Figure 13:
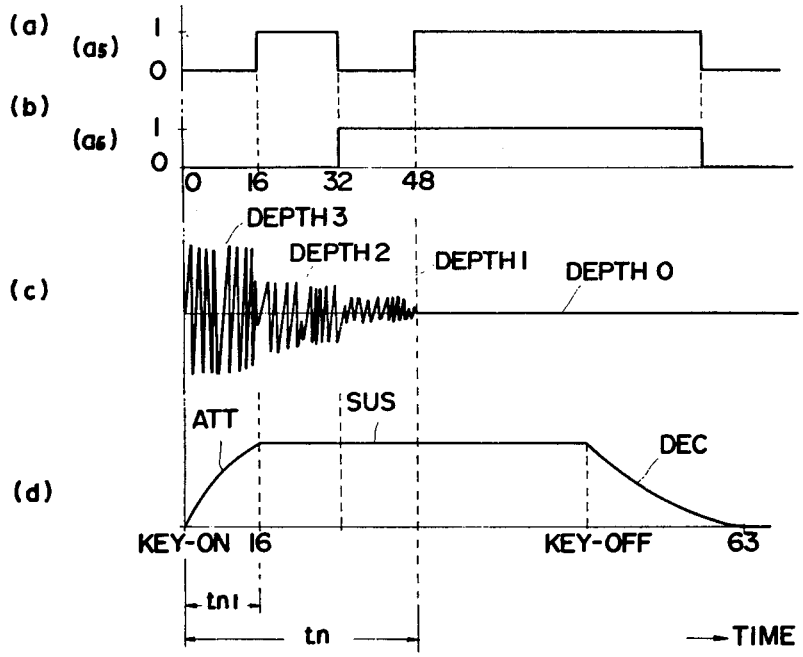
FIGS. 13(*a*) through 13(*c*) are timing charts illustrative of a relation between the stepwise generation of the depth signal and an envelope waveshape.
Figure 14:
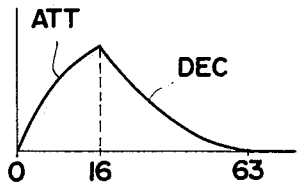
FIG. 14 is a graphic diagram showing an example of a waveshape stored in an envelope memory 21.

As shown in FIGS. 13(*a*) and 13(*b*), the signal $a_6$, $a_5$ is 00 and the depth signal $W_2$, $W_1$ is 11("depth 3") when the count is 0 - 15, the signal $a_6$, $a_5$ is 01 and the depth signal $W_2$, $W_1$ is 10 ("depth 2") when the count is 16–31, the signal $a_6$, $a_5$ is 10 and the depth signal $W_2$, $W_1$ is 01 ("depth 1") when the count is 32–47, and the signal $a_6$, $a_5$ is 11 and the depth signal $W_2$, $W_1$ is 00 ("depth 0") when the count is 48–63. Accordingly, the depth decreases as the count increases as shown in FIGS. 11(*a*) and 11(*b*), and the noise depth, i.e. the frequency modulation factor, decreases in steps with a predetermined interval after depression of a key as shown in FIG. 13(*c*). For example, the frequency modulation factor is at the maximum ("depth 3") during a period of time $tn_1$ after depression of the key and becomes 0 ("depth 0") after a lapse of time *tn*.

The speed at which the noise depth changes (i.e. the above described predetermined time) can be adjusted by changing the frequency of the clock pulse CP. The clock selector circuit 12 may be so constructed that it can produce a clock pulse hich differs depending upon the kind of keyboard. In that case, a clock pulse corresponding to a particular keyboard is produced in response to the keyboard code $K_1$, $K_2$ and the above described predetermined period of time is made different depending upon the keyboard of the depressed key.

FIG. 13(*d*) shows an example of an envelope waveshape of a musical tone produced upon depression of a key. The envelope waveshape is composed of an attack envelope ATT produced by key-on, a decay envelope DEC produced by key-off and a sustain state SUS. FIGS. 13(*c*) and 13(*d*) clearly show that the noise depth is at the maximum during the rise portion (attack) of a tone, producing the noise effect during the attack.

In the present embodiment, the first and second noise information is produced randomly as in the previously described embodiment. The frequency of a musical tone to be reproduced is randomly deviated to either one of the frequency $f_1$ or $f_2$, and a husky musical tone of an unstable pitch is reproduced. Since the frequency modulation factor decreases in steps from the start of depression of the key as shown in FIG. 13(*c*), the greatest noise effect is produced during the time $tn_1$ (i.e. the range of deviation in the frequencies $f_1$ and $f_2$ is at the maximum). The range of the random deviation in the frequencies $f_1$ and $f_2$ is thereafter reduced in steps and, after a lapse of the time $t_n$, a musical tone of a stable nominal pitch, i.e. a musical tone corresponding to the basic frequency is reproduced. In the foregoing manner, the noise effect is given to a musical tone during the attack time so that the musical tone will be of an unstable pitch including a coarse noise component during the attach time and thereafter maintain a stable pitch.

Since the probability that the first or the second noise information is produced is even, the pitch perceivable to human hearing is a mean value of the frequencies $f_1$ and $f_2$, i.e. the pitch of the basic frequency. Accordingly, a unique, husky musical effect is emphasized during the attack time without giving rise to an unpleasant feeling of a noise, whereby a pleasant musical tone which is a close simulation of a natural wind instrument is reproduced.

The foregoing description has been made with respect to the embodiment in which the depth of frequency-modulation by a noise gradually decreases. The invention is not limited to this but the frequency-modulation may remain constant during a predetermined period of time from the key-on and the depth of frequency-modulation may thereafter change, if such arrangement provides a desired special musical effect.

What is claimed is:

1. An electronic musical instrument for producing a musical tone waveshape representing a musical tone having random vibrato, comprising means for producing a key address code corresponding to a depressed key;

a frequency information memory for storing frequency information corresponding to predetermined pitches of respective keys and producing, upon receipt of the key address code, frequency information corresponding to the key address code;

a noise pulse generator for producing a pulse at random ones of regularly occurring time intervals;

means for producing a vibrato depth signal which represents a frequency-modulation factor;

a noise information generation circuit for producing, in response to the output of said noise pulse generator, noise information for frequency-modulating said predetermined pitches of respective keys with a frequency modulation factor corresponding to said depth signal;

a calculating device for producing modified frequency information of a value obtained by frequency-modulating the frequency information by means of the noise information supplied from said noise information generation circuit;

a frequency counter for receiving and cumulatively adding the modified frequency information;

a musical tone waveshape memory for previously storing a desired musical tone waveshape and producing it is response to the output of said frequency counter; and envelope control means for controlling the entire level of the musical tone represented by the waveshape produced by said memory.

2. An electronic musical instrument as defined in claim 1 wherein said noise information generation circuit produces first noise information which frequency-modulates said predetermined pitches of respective keys in a positive direction when the noise pulse is applied to said noise information generation circuit from said noise pulse generator and second noise information which frequency-modulates said predetermined pitches in a negative direction when the noise pulse is not applied to said noise information generation circuit.

3. An electronic musical instrument as defined in claim 1 further comprising means for changing the contents of said noise information in accordance with the kind of keyboard.

4. An electronic musical instrument as defined in claim 1 wherein said means for producing the depth signal are capable of producing a variable depth signal which decreases the frequency modulation factor from a predetermined initial value to zero during a predetermined period of time from the start of depression of key.

5. An electronic musical instrument as defined in claim 4 further comprising means for controlling the speed of decrease of the frequency modulation factor in accordance with the kind of keyboard.

6. An electronic musical instrument as defined in claim 4 wherein a main portion of said predetermined period of time during which the variable depth signal is produced is an attack portion of the musical tone.

* * * * *